United States Patent [19]

Whitener, Jr. et al.

[11] Patent Number: 4,764,876

[45] Date of Patent: Aug. 16, 1988

[54] PROFILE ANALYZER FOR FILAMENTARY MATERIALS

[76] Inventors: Charles G. Whitener, Jr., 1465C Howell Mill Rd.; Gary Hibbard, 1465C Howell Mill Rd., both of Atlanta, Ga. 30318

[21] Appl. No.: 923,188

[22] Filed: Oct. 27, 1986

[51] Int. Cl.[4] ..... G06F 15/46; G08B 21/00; G01N 21/89

[52] U.S. Cl. ..... 364/470; 364/552; 73/160; 340/677; 356/430

[58] Field of Search ..... 364/469, 470, 563, 560, 364/562, 552; 73/160; 340/677; 356/386, 429, 430

[56] References Cited

U.S. PATENT DOCUMENTS

| | | | |
|---|---|---|---|
| 3,731,069 | 5/1973 | Goto et al. | 364/470 |
| 3,907,440 | 9/1975 | Eichenberger et al. | 356/429 |
| 4,045,659 | 8/1977 | Akagawa et al. | 73/160 |
| 4,057,350 | 11/1977 | Craig | 73/160 |
| 4,058,962 | 11/1977 | Spescha et al. | 73/160 |
| 4,060,965 | 12/1977 | Schwartz | 340/677 |
| 4,168,604 | 9/1979 | Mannhart | 364/470 |
| 4,294,545 | 10/1981 | Stutz | 356/386 |
| 4,306,812 | 12/1981 | Lapp et al. | 356/429 |
| 4,378,161 | 3/1983 | Maddox | 356/430 |
| 4,491,831 | 1/1985 | Sakai et al. | 340/677 |
| 4,648,054 | 3/1987 | Farah et al. | 364/552 |
| 4,656,465 | 4/1987 | Erni et al. | 340/677 |

*Primary Examiner*—Parshotam S. Lall
*Assistant Examiner*—Steven A. Melnick
*Attorney, Agent, or Firm*—James B. Middleton

[57] ABSTRACT

A device for analyzing the characteristics of filamentary material while the filamentary material moves at high speed, and a method for using the device. The material is moved past a sensing array while a light shines against the array. The material will block the light to portions of the array; and, since the array is scanned by an electrical signal of high frequency, a width of the material will be indicated by the output signal. Successive scans, and successive widths, are stored in computer storage, and a profile of the material is constructed. Various statistical data can be computed, and a stop motion device can be activated in the event material is beyond preset standards.

9 Claims, 4 Drawing Sheets

TACS/METER

PROFILE ANALYZER FOR FILAMENTARY MATERIALS

INFORMATION DISCLOSURE STATEMENT

In the manufacture of filamentary materials, it is very often necessary to analyze the profile of the material in order to determine quality. More specifically, a number of materials are required to have a certain diameter, and perhaps a certain pattern in variations in the diameter along the length of the material. These filamentary materials are usually of sufficiently small diameter that quality review by the human eye is impracticable.

There has been some effort at utilizing electronic means for analyzing the profile of filamentary materials, for example U.S. Pat. No. 4,491,831 which discloses a method for detecting yarn diameters outside a certain range. The primary drawback with such a method is that it is designed only to signal irregularities beyond a certain range, and is not designed to provide an analysis of a filament that is intended to be irregular.

In the textile industry, tac entangled yarn is quite popular, and the yarn must be substantially uniform or undesirable streaks and the like appear in carpeting tufted with the yarn. Tac entangling is carried out at speeds of 500 meters per minute or more, so visual inspection is impossible. While a method such as that disclosed in U.S. Pat. No. 4,491,831 could determine when diameters of the yarn exceeded a given limit, such a method cannot indicate the quality of the yarn in terms of tacs and balloons as is required for a complete analysis of the quality of the yarn.

SUMMARY OF THE INVENTION

This invention relates generally to a method and apparatus for monitoring filamentary material, and is more particularly concerned with means for analyzing the profile of a filament.

The present invention provides apparatus for analyzing the profile of a filament, including a source of radiation and a sensing array so that the filament can pass between the light source and the sensing array, and the sensing array will read the width of the filament at that position. This information is retained in a latch, and fed to a microcomputer. The apparatus is utilized with the filament moving lengthwise, and the sensing array is activated by a start pulse at discrete intervals. Thus, as the filament moves, and the sensing array is activated at periodic intervals, each of the widths will be stored by the microcomputer, along with information with respect to the motion of the filament. A plurality of these widths can therefore be assembled by the computer to yield the desired picture of the filament.

The method of the present invention therefore includes the steps of providing a plurality of successive widths of a filament, and storing the plurality of widths. With the widths stored, characteristic values of the widths are analyzed, and certain values can be compared with preset values. The preset values can be utilized as limits to cause portions of the filament to be rejected if desired. After all of the information is collected, the computer can then provide various outputs, including graphic representation of the yarn, digital representations of the yarn profile, and various statistical values analyzing diameters of filament.

For a tac entangled yarn, it will therefore be seen that the present invention can provide all the information necessary to determine if the tacs and balloons are of appropriate lengths, if there is the appropriate number of tacs per unit length, if the diameter of tacs and of balloons are within the predetermined ranges and the like.

BRIEF DESCRIPTION OF THE DRAWING

These and other features and advantages of the present invention will become apparent from consideration of the following specification when taken in conjunction with the accompanying drawings in which.

DETAILED DESCRIPTION OF THE EMBODIMENT

Figure 1:
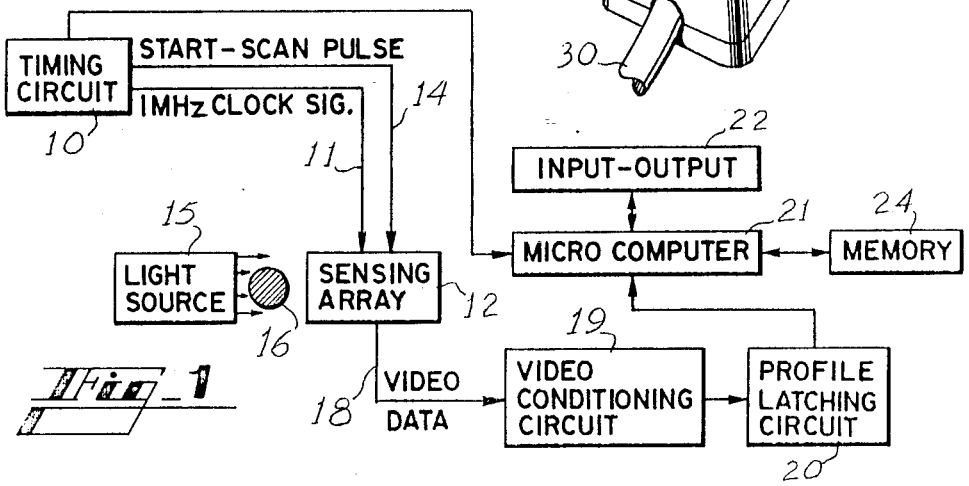
FIG. 1 is a block diagram illustrating a profile analyzer made in accordance with the present invention.

Referring now more particularly to the drawings, and to that embodiment of the invention here presented by way of illustration, FIG. 1 shows a block diagram for a general understanding of the invention. A timing circuit 10 provides the usual clock signal that is appropriately divided or otherwise adjusted to provide a time base as needed. As here indicated, the line 11 conveys a 1 MHz signal to the sensing array 12. The signal on line 11 determines the rate at which the sensing array 12 operates, but a line 14 provides a start pulse. Thus, the sensing array 12 receives a start pulse, then the sensing array is scanned at the rate of the 1 MHz signal on line 11.

As shown in FIG. 1, there is a light source 15, and the filament 16 will pass between the light source 15 and the sensing array 12. As light is propagated from the light source 15, the light will be blocked by the filament 16 so that a portion of the sensing array 12 will not receive light. The sensing array 12 indicates which portions receive light and which do not, and provides an output signal on the line 18 fed to the video conditioning circuit 19. The video conditioning circuit 19 places the signal in condition for storage in the profile latching circuit 20 to be read by the microcomputer 21.

As indicated in FIG. 1, the microcomputer 21 is connected to input-output means 22 and memory means 24. the input-output means 22 may include conventional key pads as well as individual push buttons and other sensing means, and may include cathode ray tubes, printers and other conventional output means. The memory 24 may include conventional data storage means, and may include at least a ROM (read only memory) for storage of programming and the like, and a RAM (random access memory) for temporary storage of data and data manipulation.

It should now be understood that the filament 16 will be moving in a direction perpendicular to the sheet of drawings, and the light source 15 will be constant, casting a "shadow" on the sensing array 12. At a given instant, the start pulse will be received on the line 14, and the individual components making up the sensing array 12 will be scanned at the rate of 1 MHz. Thus, even with the filament 16 moving at a rather high rate of speed, the length of filament sensed by the sensing array 12 during one scan will be very short. When the results of one scan have been stored in the latch 20, and read by the microcomputer, that width can be removed from the latch 20 so the latch is ready to receive another width. The sensing array 12 is again scanned and another width is measured and stored in the latch 20. A series of widths is therefore detected by the sensing array 12, temporarily stored in the latch 20, read by the microcomputer 21 and stored in memory 24. Thus, the computer 21 can retrieve the information from the memory 24 and compile a profile of the filament 16 throughout the length stored.

Figure 2:
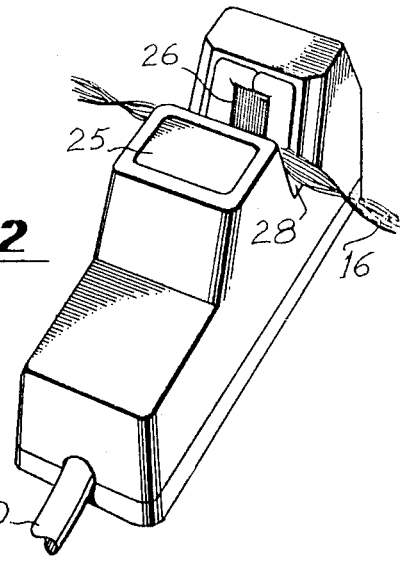
FIG. 2 is a perspective view illustrating one form of scanning means for use with the present invention.

Attention is next directed to FIG. 2 of the drawings which shows one form of apparatus for sensing the filament 16. The light source 15 is within the housing 25, and the sensing array 12 is mounted in the window 26. The groove 28 is provided for passage of the filament 16. Thus, the apparatus shown in FIG. 2 and designated generally at 29 can be mounted in the path of the filament 16 in the usual processing machinery, the filament can be passed through the groove 28, and the electrical line 30 can carry the signals to and from the sensing array 12.

It is contemplated that the present invention will find utility in numerous applications since the apparatus can detect and analyze the profile of virtually any filamentary material. By way of example, and without intent to limit the scope of the invention, the specific embodiment of the invention here presented is designed for analyzing tac entangled yarns. While specific features of the tac entangled yarn are used as indicators, those skilled in the art will readily understand that comparable characteristics of other filamentary materials could be easily substituted therefor without changing the present inventive concept.

Figure 3:
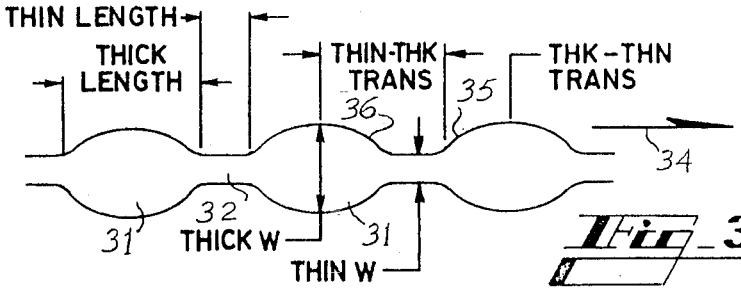
FIG. 3 is a schematic illustration showing a tac entangled yarn.

Looking now at FIG. 3 of the drawings, a profile of tac entangled yarn is illustrated. the conventional tac entangled yarn includes a plurality of balloons 31 connected by tacs 32. Thus, if the yarn in FIG. 3 is moving in the direction indicated by the arrow 34, it will be understood that the lefthand side of the balloons 31, indicated at 35 will be read by the apparatus of the present invention as a transition from a large diameter to a small diameter, or here characterized as a thick-thin transition. Similarly, the right hand side of the balloons, indicated at 36, will be read as a change from small diameter to large diameter, or characterized here as a thin-thick transition.

Figure 4:
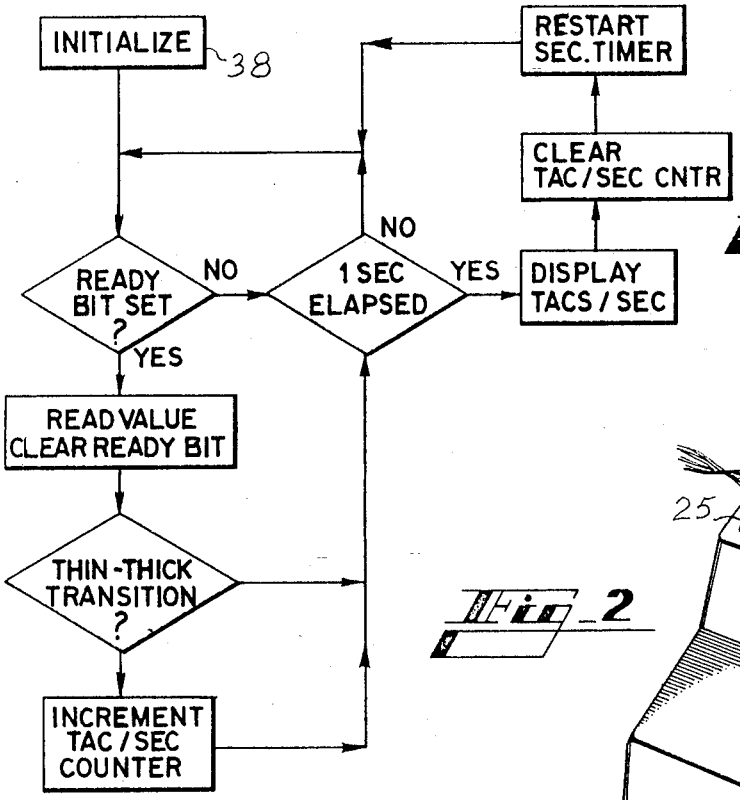
FIG. 4 is a flow chart illustrating the system for determining tacs per second for use with the present invention.

With this background, attention is directed to FIG. 4 of the drawings which illustrates the system for providing information as to the number of tacs per second in the yarn being analyzed. It will be seen that the system is initialized at 38, and the computer first determines if a ready bit is set. If the answer is yes, it is an indication that a profile has been stored in the latch 20, so the value is read, and the ready bit is cleared. Next, there is a determination as to whether or not a thin-thick transition has been encountered. It will be remembered that each thin-thick transition is an indication that a tac has just passed. Thus, if the answer to this query is yes, the tac per second counter is incremented, and the program checks to see if one second has elapsed. If the answer is yes, the tacs per second can be displayed; but, if a second has not elapsed, the loop returns to see if the ready bit is set, so another value can be read to repeat the sequence.

After the tacs per second has been displayed, the counter is cleared, and the one second timer is restarted to repeat the sequence.

It will therefore be seen that a length of yarn can be scanned, and the presence of the thin-thick transitions is an indication that tacs are passing the sensing array. By incrementing a counter each time a thin-thick transition is encountered, and continuing this operation for a period of one second, the tacs per second will be the resulting information.

Figure 5:
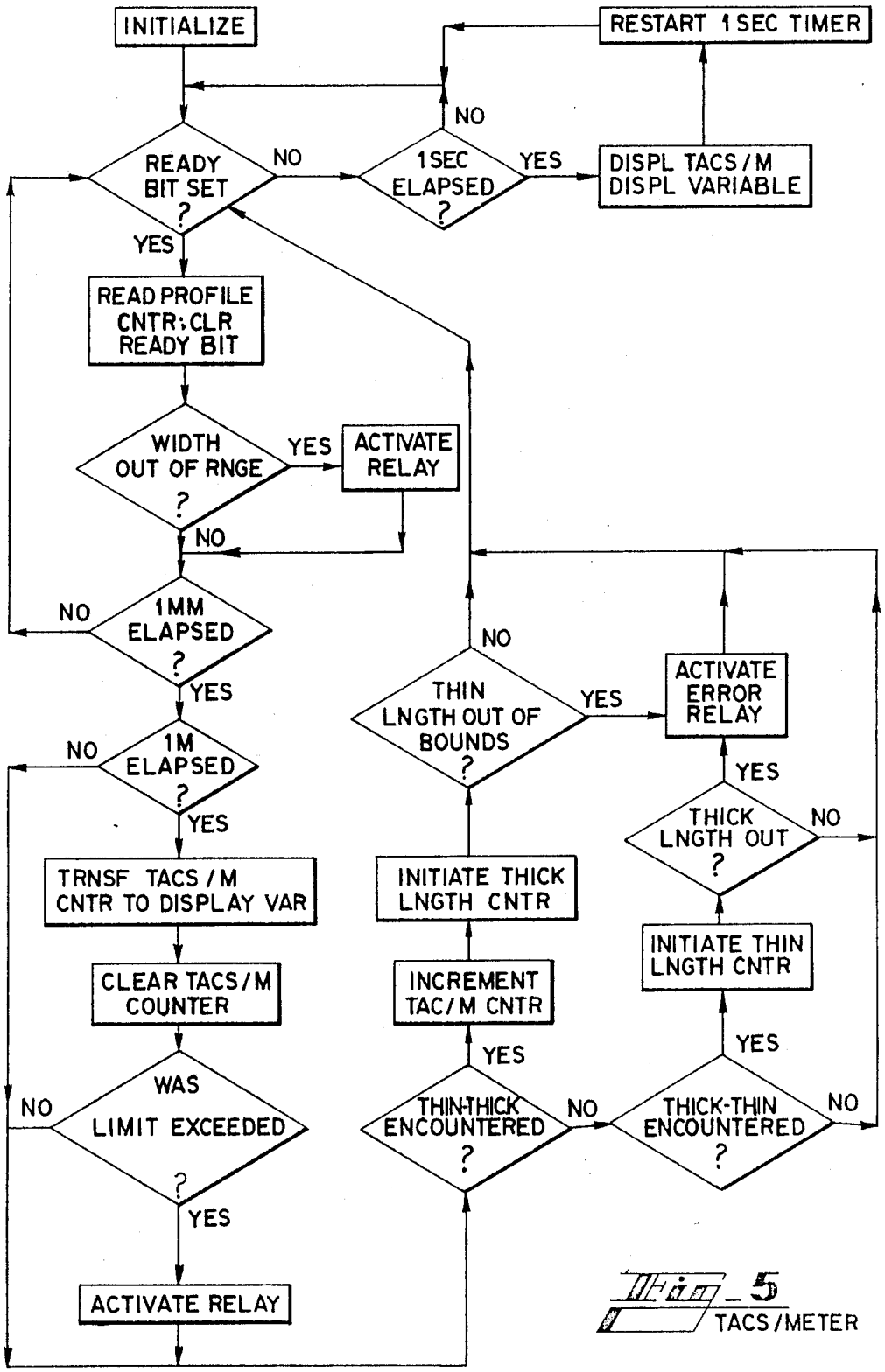
FIG. 5 is a flow chart showing the system for counting tacs per meter for use with the present invention.

Utilizing the same apparatus, it will be understood that a feature of the yarn per unit length can also be determined. FIG. 5 shows a flow chart for determining the number of tacs per meter of yarn. the program is initialized, and the first inquiry is whether or not a ready bit is set. As before, if the ready bit is set, it is an indication that a width has been stored in the profile counter, so the information is read, and the ready bit is cleared. Looking at the width read, the next determination is whether or not the width is out of a predetermined range. If the answer is yes, a relay is activated, and this relay can be used as a stop motion device or otherwise as the user sees fit.

If the width is not out of range, the system continues to determine if a length of 1 mm has passed. If the answer is negative, the system returns to the beginning, but if a milimeter has elapsed the system inquires as to whether or not one meter has elapsed.

At the beginning of the scan, clearly a meter will not have passed, resulting in a no answer so the system skips to inquire if a thin-thick transition has been encountered. If the answer is yes, the tacs per meter counter is incremented because this is an indication that the end of a tac has been encountered. A thick length counter is also initiated, then the inquiry is made as to whether or not the thin length is beyond the predetermined limits. As before, if the answer is yes, a relay can be activated to act as a stop motion or the like. If the thin length is not outside the preset limits, the system returns to the beginning and continues with another reading. This sequence will continue until one meter has in fact elapsed.

When a meter has elapsed, each tac having been counted throughout the length, the tacs per meter counter is transferred to the tacs per meter display variable, then the tacs per meter counter is cleared. At this point, inquiry is made as to whether or not the number of tacs per meter is beyond a preset limit. If the answer is yes, a relay can be activated to act as a stop motion or the like, and if no the system continues as previously described.

It will therefore be seen that, by providing the plurality of widths, and utilizing the transitions from thin to thick or thick to thin, the desired characteristics of the filament can be cataloged. In the flow diagram for the system of FIG. 5, the thin-thick transition indicates the end of a tac, and a tac can be counted.

From the above description, it will be understood that the apparatus disclosed in FIGS. 1 and 2 can be utilized to provide successive width along the length of a filament; and, by examining the changes in the widths, certain statistical information can be compiled. Looking at FIGS. 6 and 7, it will now be understood that the profile of a length of yarn can be analyzed apart from merely counting tacs and the like.

Figure 6:
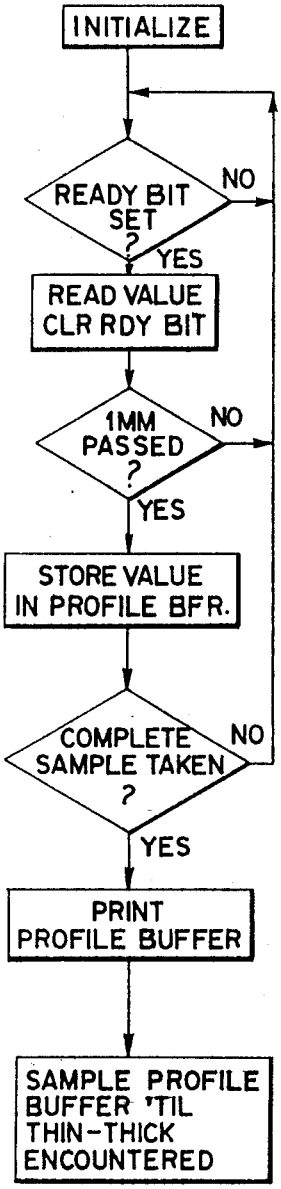
FIG. 6 is a flow chart showing the system for placing each profile in memory for use with the present invention.

Looking at FIG. 6, the system is initialized, and the first inquiry is whether or not a ready bit is set to indicate that a width has been stored. If the answer is yes, the value is read and the ready bit is cleared. The next inquiry is whether or not 1 mm of filament has passed, and if the answer is yes the previously read value is stored.

The next inquiry is whether or not a complete sample has been taken, The sample will be determined by the operator, and so long as the sample has not been completed, the system will return to read another width and continue until a complete sample has been taken as specified. Once the sample has been taken, the entire sample will be stored in the profile buffer, and the contents of the profile buffer is printed.

Figure 7:
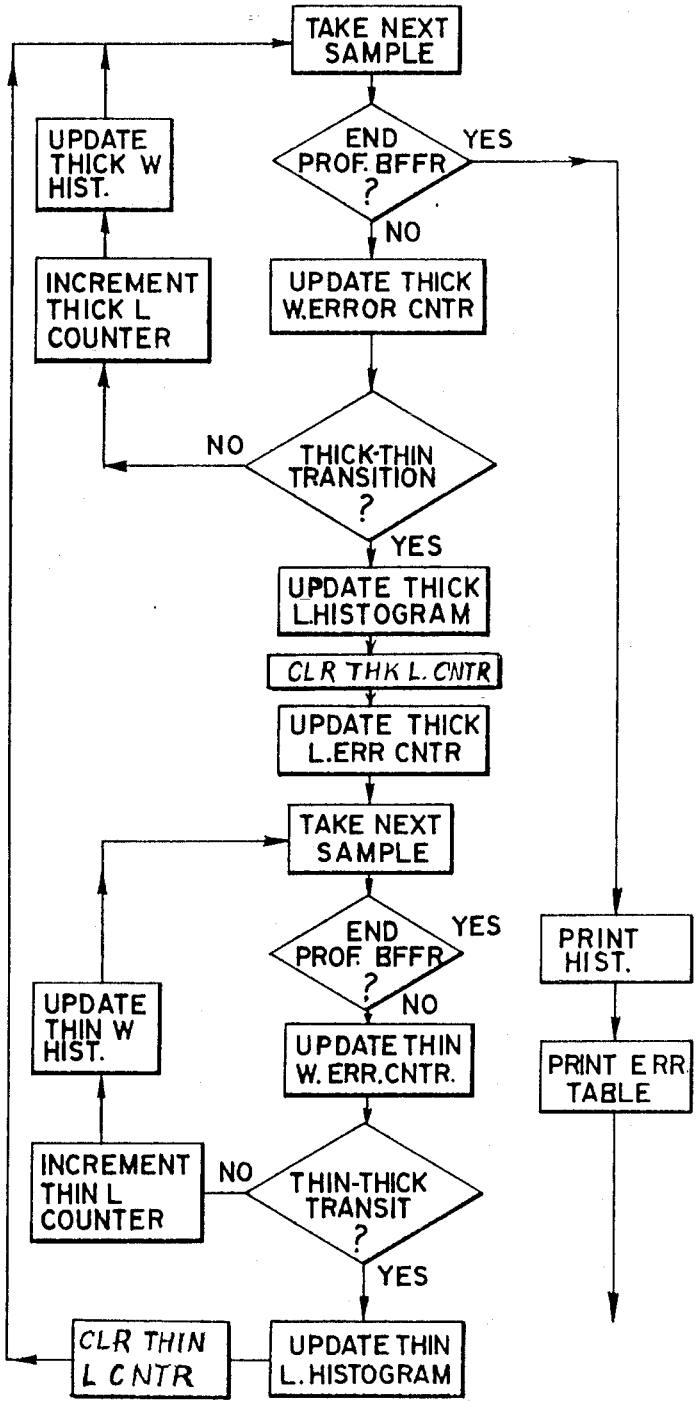
FIG. 7 is a flow chart showing a system for analyzing a length of tac entangled yarn; and, FIG. 8 is a block diagram showing one form of apparatus for carrying out the present invention.

Looking at FIG. 7, it should be understood that the end of FIG. 6 will lead into FIG. 7, the first instruction being to take the next sample. The first inquiry is whether or not the end of the profile buffer has been reached. If so, the material is printed, but if not, the error counter is updated if necessary and inquiry is made as to whether or not a thick-thin transition has been encountered. Since a thick-thin transition will indicate a balloon has just been passed, the next steps are to update the thick length histogram, clear the thick length counter, and update the thick length error counter if necessary.

If a thick-thin transition was not encountered, the thick length counter must be incremented, and the thick width histogram is also updated, to return to the beginning and take the next sample.

Returning now to the next sample following updating the thick length histogram, inquiry is made as to whether or not the end of the profile buffer has been reached. If no, the thin width error counter is updated as necessary, and the query is whether or not a thin-thick transition has been encountered. If no, the counter for the thin length must be incremented, the histogram is updated, the thin length counter is cleared and a new sample taken. If a thin-thick transition has been encountered, it is an indication of the end of a tac, and the this length histogram is updated, the counter cleared and the system returns to the beginning to take a new sample.

It will therefore be understood that the system disclosed in FIG. 7 provides one loop for the balloons, and the loop is returned on the basis of the end of a balloon. If the end of a balloon is not encountered, the system continues to the next loop that is formed by encountering a thin-thick transition, which is the end of a tac. The entire system therefore provides information as to the width of the balloon, and width of the tacs, as well as the length of the balloons and length of the tacs. This information can be utilized to provide such visually readable charts and the like as may be desired.

Figure 8:
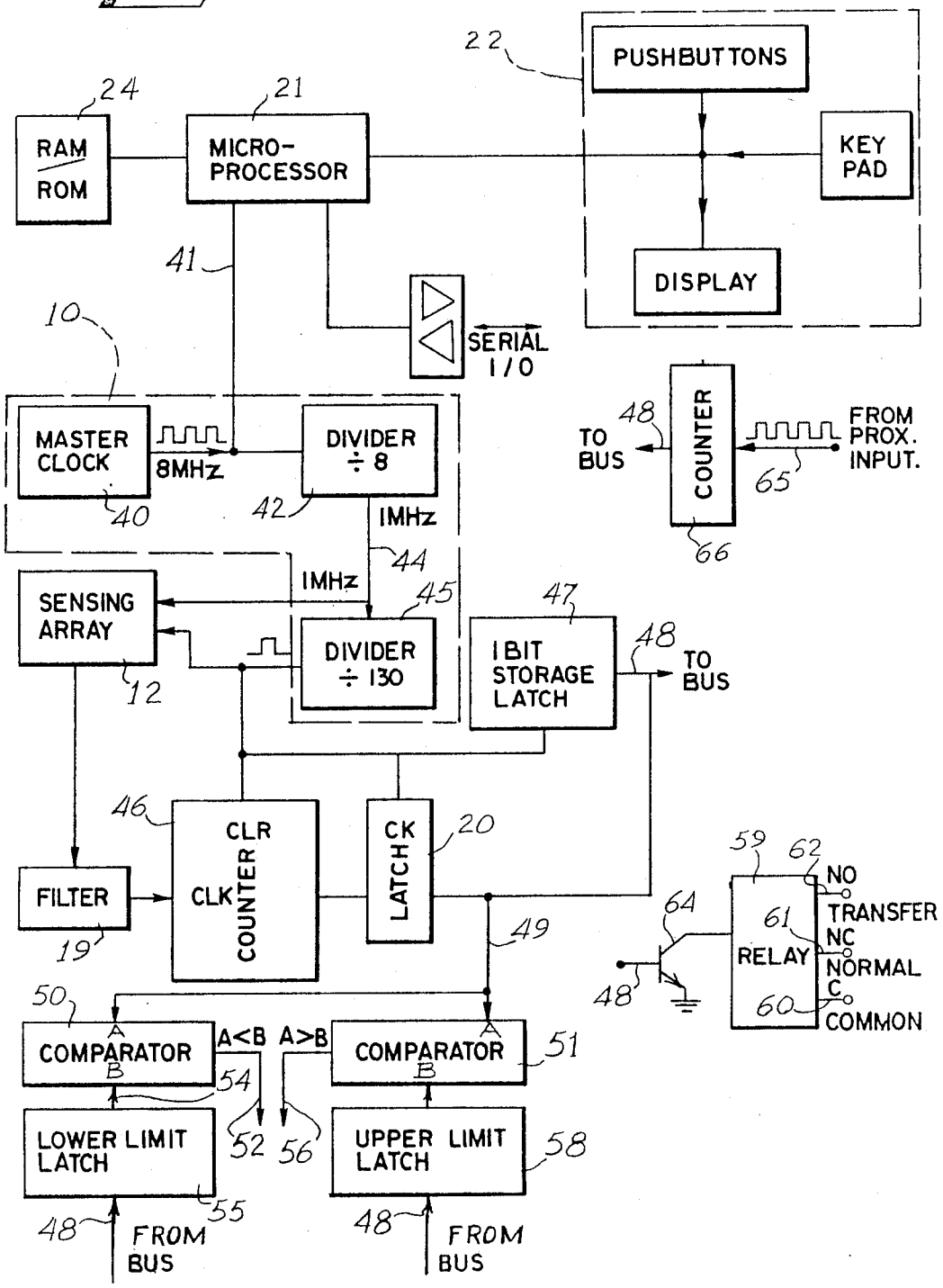

FIG. 8 of the drawings illustrates the circuitry for the present invention. It will here be seen that the timing ciruit 10 includes a master clock 40 for providing a clock signal. The signal from the master clock 40 is fed through the line 41 to the microprocessor 21, and also to a first divider circuit 42. The output from the divider circuit 42 is then fed along the line 44 to a second divider circuit 45, and to the sensing array 12.

Though the particular frequencies utilized in apparatus of the present invention are subject to considerable variation depending on the particular design, in one successful embodiment the frequency produced by the master clock 40 is an 8 MHz signal, and the first divider circuit 42 is a divide-by-8 circuit which yields a 1 MHz signal. This 1 MHz signal is then fed directly to the sensing array 12, and is also fed to the second divider circuit 45 which is a divide-by-130 divider.

The sensing array 12 may take the form of a charge coupled device (CCD). As is known by those skilled in the art, the CCD can be started by a start-scan pulse; and, conventionally a charge will be transferred through successive gates. It is also known to those skilled in the art that the charge packets can be generated photoelectrically to act in the nature of a television camera with a digital output. This latter operation is utilized in the present invention, an output being provided where the filament does not block the radiation from the light source.

Utilizing a CCD with 128 gates, or elements, and scanning at a rate of 1 MHz, it will be seen that the entire width of the filament will be scanned in a very short period of time so that the filament is effectively stopped. Since the second divider circuit 45 divides by 130, a new scan will be started almost 7200 times per second. Thus, even with the filament, or yarn, travelling at a rate of 500 meters per minute the length "photographed" by the sensing array 12 for each successive width will be only about 1 mm long. It will be understood that the second divider circuit provides the start-scan pulse for the CCD, so the division must be such that the entire CCD is scanned before the next start-scan pulse. Thus, with 128 gates, a divide-by-130 is appropriate, allowing some tolerance in the timing.

The output from the sensing array 12 is passed through the filter 19 to convert the output to a square wave, but having the same frequency, and the information of the width scanned. A signal is fed from the filter 19 to a counter 46, and it will be seen that the second divider circuit 45 sends its output to the clear terminal of the counter 46. Thus, each time a new scan is started in the sensing array 12, the counter 46 is cleared to be ready for the next signal from the filter 19.

The signal continues from the counter 46 to the latch 20. The latch 20 stores the width as has been previously discussed, and is available to be read by the microprocessor 21 from the line 48.

The output from the divider 45 is fed to the one bit storage latch 47, and also the latch 20. Thus, the microprocessor 21 can read on the line 48 and determine if a bit is stored in the latch 47. If so, it is an indication that a width has been stored in the latch 20. The microprocessor 21 can therefore read the information from the latch 20, and the next pulse from the divider 45 will clear the latch 20 so it is prepared for the next width. The one bit storage latch 47 is cleared at the time the microprocessor 21 reads the latch 20.

All of the information read from the yarn may be stored in the storage 24 of the microprocessor 21; however, to conserve memory, some of the processing may optionally be done by comparators. By way of example, FIG. 8 shows a line 49 branching off the line 48, and there are two comparators 50 and 51. There is a lower limit latch 55 and an upper limit latch 58 connected to the comparators 50 and 51 respectively. It will therefore be seen that the microprocessor 21 can write the upper and lower limits into the latches 55 and 58; and, each new value from the latch 20 will be compared with the limits. If either limit is exceeded, a signal will be provided on the line 52 or 56. Such a signal may be directed to the microprocessor 21 for some action, or may activate a stop motion device or the like.

FIG. 8 also includes a relay 59 which has the usual common point 60, normal point 61 and transfer point 62. The relay 59 is controlled through a transistor 64 having its base connected to the line 48 for control by the microprocessor 21. Thus, when the microprocessor 21 determines that a value is out of line, a signal can be provided on the bus 48 to trigger the transistor 64. By appropriate connection of the contacts of the relay 64, the relay can comprise a stop motion device, or can activate an ink jet for marking bad goods or the like.

Several aspects of the present invention require information as to the speed of the yarn being analyzed. This information can be provided from proximity apparatus or other yarn speed indicators well known in the art. A signal will be provided on the line 65 to a counter 66, so the counter 66 will have an indication of yarn speed. This indication is then provided on the line 48 for access by the microprocessor 21.

From the foregoing description, it will now be understood that the present invention provides apparatus for scanning a yarn while the yarn moves at a high rate of speed through conventional processing equipment. As the yarn is scanned, the speed of the scanning apparatus effectively stops the yarn and provides an indication of the width of the yarn at a given point, or slice through the yarn. By providing a plurality of successive widths at successive points along the length of the yarn, the entire profile of the yarn can be analyzed. While the example here presented is tac entangled yarn, and the thin-thick and thick-thin transitions are utilized, it will be obvious that, with the same arrangement, high and low values can be constantly monitored, and lengths of given widths can be monitored. Thus, the method and apparatus of the present invention are applicable to numerous systems concerning a filamentary material.

In the textile industry alone, it will be obvious that yarns can be monitored as to their thickness, so the apparatus can be utilized to determine a change in denier which may indicate a ply dropout, or use on slubbed yarn can indicate thickness of the slubs and of the yarns between slubs, as well as indicating the number of slubs per unit length for maintenance of overall quality.

It will therefore be understood that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

We claim:

1. A method for analyzing a length of filamentary material including the steps of continuously moving the filamentary material past a sensing array comprising a plurality of discrete points, continuously directing radiation towards said sensing array so that all of said discrete points of said sensing array receive said radiation except where said sensing array is blocked by said filamentary material, scanning said sensing array electrically to obtain an electrical output that indicates the portions of said sensing array that are blocked by said filamentary material at the time of the scanning of said sensing array to obtain a first width of said filamentary material, storing said first width and again scanning said sensing array to obtain a second width, storing said second width, and continuing the process until said length has been moved past said sensing array to obtain a series of widths, said series of widths making up a profile of said length of filamentary material, and further including the steps of establishing width limits for said filamentary material, and subsequently comparing widths of the filamentary material moving past said sensing array with said width limits for the filamentary material.

2. A method as claimed in claim 1 wherein said filamentary material has thick portions and thin portions, and including the steps of incrementing a thick length counter each time the series of widths changes from a predetermined thick width to a predetermined thin width.

3. A method as claimed in claim 1 wherein said filamentary material has thick portions and thin portions, and including the steps of incrementing a thin length counter each time the series of widths changes from a predetermined thin width to a predetermined thick width.

4. A method as claimed in claim 2, and including the steps of incrementing a thin length counter each time the series of widths changes from a predetermined thin width to a predetermined thick width.

5. A method as claimed in claim 4, and further including the step of providing a signal indicating the speed at which said filamentary material moves past said sensing array, and using the quantity stored in the thick length counter to compute the number of thick lengths per unit of time.

6. A method as claimed in claim 5, and including the step of using the quantity stored in the thin length counter to compute the number of thin lengths per unit of time.

7. Profile analyzing apparatus for analyzing a length of filamentary material including a sensing array having a plurality of sensing points, radiation means for directing radiation towards said sensing array, said length of filamentary material being receivable between said radiation means and said sensing array and movable longitudinaly therethrough, means for producing a clock signal for determining the scanning rate for scanning said sensing means, means for producing a start-scan pulse for starting a scan of said plurality of points of said sensing array, and scanning means for scanning said sensing array and for producing an electrical output from said sensing array representing one width of said filamentary material, said means for producing a start-scan pulse being timed such that said sensing array will be scanned before the subsequent start-scan pulse is provided, the arrangement being such that some of said plurality of sensing points of said sensing array will be blocked by said filamentary material and not receive said radiation to vary said electrical output in accordance with said width of said filamentary material, output storage means for storing said electrical output, computer means having storage means, said output storage means being electrically connected to said sensing array for receiving said electrical output, said output storage means being electrically connected to said computer means for transfer of said electrical, output to said storage means fof said computer means, the arrangement being such that successive electrical outputs representing successive widths of said length of filamentary material are stored and represent a profile of said filamentary material, means for defining width limits for said successive widths, and means for comparing said successive widths with said width limits for said successive widths.

8. Apparatus as claimed in claim 7, said sensing array comprising a charge coupled device having a plurality of gates, said radiation means comprising a light source for directing light towards said charge coupled device, said means for producing a clock pulse including a master clock for generating a first frequency, a first divider for dividing said first frequency to produce a second frequency, and a second divider for dividing said second frequency to produce a third frequency, said second dividier dividing by a number greater than the number of said plurality of gates, said second frequency determining said scanning rate for scanning said sensing array, said third frequency constituting said start-scan pulse.

9. Apparatus as claimed in claim 8, said means for comparing said successive widths with said width limits including a comparator for receiving said electrical output from said output storage means, means for providing said width limits to said comparator for comparison with said electrical output, and means for receiving a signal from the comparator when said limit is exceeded.

* * * * *

US004764876B1

REEXAMINATION CERTIFICATE (2040th)

United States Patent [19]

[11] B1 4,764,876

Whitener, Jr. et al.

[45] Certificate Issued Jun. 15, 1993

[54] PROFILE ANALYZER FOR FILAMENTARY MATERIALS

[75] Inventors: Charles G. Whitener, Jr.; Gary Hibbard, both of Atlanta, Ga.

[73] Assignee: Microdynamics Corporation

Reexamination Request:
No. 90/002,153, Oct. 2, 1990

Reexamination Certificate for:

| | |
|---|---|
| Patent No.: | **4,764,876** |
| Issued: | **Aug. 16, 1988** |
| Appl. No.: | **923,188** |
| Filed: | **Oct. 27, 1986** |

[51] Int. Cl.[5] ..... G06F 15/46; G08B 21/00; G01N 21/89

[52] U.S. Cl. ..... 364/470; 364/552; 73/160; 340/677; 356/430

[58] Field of Search ..... 364/552, 563, 562, 560, 364/470, 469, 468, 507; 73/160; 250/571, 570, 561, 560; 356/430, 429, 431, 387, 385, 386

[56] References Cited

U.S. PATENT DOCUMENTS

| | | | |
|---|---|---|---|
| 4,046,536 | 9/1977 | Smithgall, Sr. | 356/430 X |
| 4,097,849 | 6/1978 | Taylor | 356/385 X |
| 4,152,767 | 5/1979 | Laliotis | 364/560 |
| 4,270,252 | 6/1981 | Harrison | 356/429 X |
| 4,274,746 | 6/1981 | Cardell et al. | 356/429 |
| 4,294,545 | 10/1981 | Stutz | 356/386 |
| 4,430,720 | 2/1984 | Aemmer | 364/552 |
| 4,648,054 | 3/1987 | Farah et al. | 364/552 |
| 4,895,449 | 1/1990 | Marshall | 356/386 |

OTHER PUBLICATIONS

"Uster Application Note E110 and E109", copyright 1982, Brochure of Zellweger Uster Ltd.

Herbert Stein GmbH & Co. KG, "Operating Instructions for Interlace Tester OBESTAT", Nov. 1980, seven pages.

Ashley et al. "Wire Burr and Thickness Detection Unit for Super Conductive Braided Cable", Society of Photo Optical Instruments and Techniques (1980), pp. 47 through 50.

Uster Corporation News Bulletin, Jul. 1974 pp. 1-28.

"Textured Yarn Quality" by M. Acar, T. G. King and G. R. Way Textile Asia vol. 17, No. 11 pp. 62-66, Nov. 1986.

*Primary Examiner*—S. P. Lall

[57] ABSTRACT

A device for analyzing the characteristics of filamentary material while the filamentary material moves at high speed, and a method for using the device. The material is moved past a sensing array while a light shines against the array. The material will block the light to portions of the array; and, since the array is scanned by an electrical signal of high frequency, a width of the material will be indicated by the output signal. Successive scans, and successive widths, are stored in computer storage, and a profile of the material is constructed. Various statistical data can be computed, and a stop motion device can be activated in the event material is beyond preset standards.

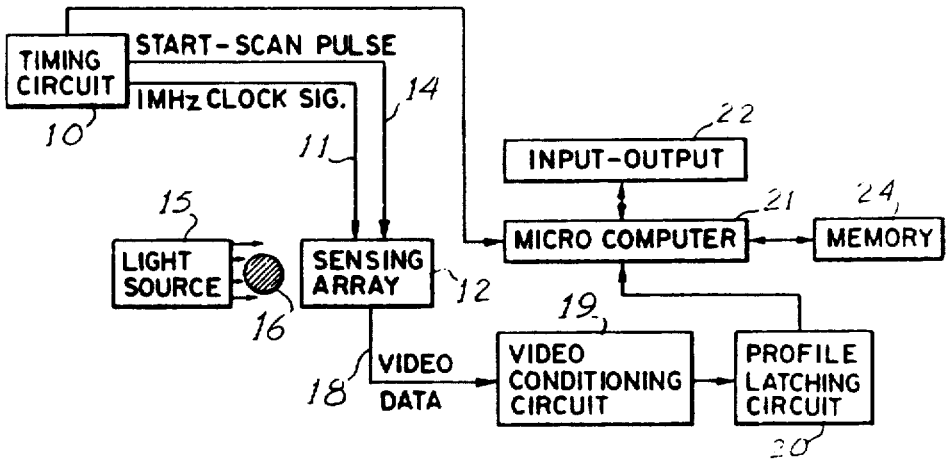

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-9 are cancelled.

* * * * *